US008051775B2

(12) United States Patent
Henderson et al.

(10) Patent No.: US 8,051,775 B2
(45) Date of Patent: Nov. 8, 2011

(54) DETONATION TO IGNITER BOOSTER DEVICE

(75) Inventors: Steven W. Henderson, Katy, TX (US); Philip Kneisl, Pearland, TX (US); Bennie C. Gill, Fulshear, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 391 days.

(21) Appl. No.: 12/175,506

(22) Filed: Jul. 18, 2008

(65) Prior Publication Data

US 2011/0239889 A1 Oct. 6, 2011

(51) Int. Cl.
*C06C 5/00* (2006.01)
*C06C 7/00* (2006.01)
*F42C 19/08* (2006.01)

(52) U.S. Cl. ..... 102/275.6; 102/275.5; 102/275.8; 102/275.11; 102/204

(58) Field of Classification Search ..... 102/275.1, 102/275.4, 275.5, 275.6, 275.8, 275.9, 245.11, 102/202, 202.5, 204, 275.11, 318
See application file for complete search history.

(56) References Cited

U.S. PATENT DOCUMENTS

| | | | | |
|---|---|---|---|---|
| 2,311,721 | A | 2/1943 | Wilson | |
| 4,317,413 | A * | 3/1982 | Strandli et al. | 102/275.9 |
| 4,541,342 | A | 9/1985 | Routledge | |
| 5,427,031 | A | 6/1995 | Bowman | |
| 6,227,116 | B1 * | 5/2001 | Dumenko | 102/275.3 |
| 6,736,068 | B1 * | 5/2004 | Dumenko et al. | 102/205 |
| 7,188,566 | B2 * | 3/2007 | Gladden | 102/275.11 |
| 2006/0272756 | A1 | 12/2006 | Kneisl | |

FOREIGN PATENT DOCUMENTS

| | | |
|---|---|---|
| EP | 40011 | 11/1981 |
| GB | 884041 | 12/1961 |
| GB | 2418975 | 4/2006 |
| GB | 2426974 | 12/2006 |
| GB | 2435645 | 9/2007 |
| GB | 2461976 A * | 1/2010 |

* cited by examiner

*Primary Examiner* — James Bergin
(74) *Attorney, Agent, or Firm* — Kevin McGoff; Rodney Warfford; Jody Lynn DeStefanis

(57) ABSTRACT

A detonating device includes a high explosive portion comprising high explosive; a low explosive portion comprising low explosive; and a transition portion between the high explosive portion and the low explosive portion, wherein the transition portion comprises a mixture of high explosive and low explosive.

18 Claims, 1 Drawing Sheet

DETONATION TO IGNITER BOOSTER DEVICE

BACKGROUND

There are many instances where detonation/ignition of explosives is useful in connection with oilfield technology, e.g., propelling and actuating certain tools and devices. Thus, involved in detonation/ignition of explosives there are numerous issues and opportunities for improvement, one of which relates to the detonation of low explosives by way of high explosives, e.g., detonation cord. The present application relates generally to using a high explosive detonation to initiate deflagration of a low explosive.

SUMMARY

An embodiment of certain features relates to a detonating device having a high explosive portion comprising high explosive; a low explosive portion comprising low explosive; and a transition portion between the high explosive portion and the low explosive portion, wherein the transition portion comprises a mixture of high explosive and low explosive.

DETAILED DESCRIPTION

Figure 1:
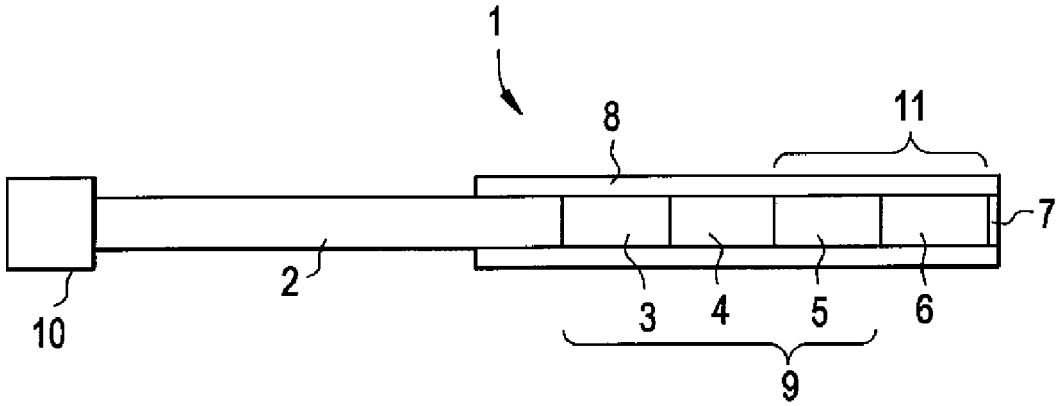
FIG. 1 is a schematic of a basic detonation system, according to an embodiment.

In the following description, numerous details are set forth to provide an understanding of various preferred embodiments. However, it will be understood by those skilled in the art that many embodiments may be practiced without many of these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

The present application generally relates to a detonating device initiating an igniter device. Generally, a detonating device is made of high explosives and the igniter device comprises low explosives.

High explosives are normally employed in mining, demolition, and military warheads. They can undergo detonation at rates of approximately 1,000 meters per second to 9,000 meters per second. High explosives are generally subdivided into two classes, primary explosives and secondary explosives, differentiated by sensitivity. Primary explosives are extremely sensitive to mechanical shock, friction, and heat, to which they will respond by burning rapidly or detonating. Secondary explosives, also called base explosives, are relatively insensitive to shock, friction, and heat. They may burn when exposed to heat or flame in small, unconfined quantities, but detonation can occur. Dynamite, TNT, RDX, PETN, HMX, and others are secondary explosives. PETN is often considered a benchmark compound, with materials that are more sensitive than PETN being classified as primary explosives.

A low explosive is usually a mixture of a combustible substance and an oxidant that decomposes rapidly (deflagration); unlike most high explosives, which are compounds. Under normal conditions, low explosives undergo deflagration at rates that vary from a few centimeters per second to approximately 400 meters per second. It is possible for them to deflagrate very quickly, producing an effect similar to a detonation. This usually occurs when ignited in a confined space. Low explosives can be employed as propellants. Examples of low explosives are gun powders (including Black Powder), pyrotechnics and illumination devices such as flares.

According to FIG. 1 in the present application, a detonating device 1 is shown. The detonation device 1 connects a detonation of a high explosive to begin a deflagration of a low explosive. The detonating device 1 has a high explosive 2, e.g. a detonating cord, that leads into a first end of an explosive tube 8. The Explosive tube 8 is preferably an aluminum tube, but can be made from any material that has adequate strength and characteristics to hold the required materials in place. On a second end of the explosive tube 8 is low explosive 6. A transition zone 9 is between the low explosive 6 and the high explosive 2. The transition zone 9 has varying mixtures of high explosive and low explosive. The ratio of high/low explosive may vary gradually increasing over the length of the transition zone 9, or there may be distinct sections each having a specific high/low explosive ratios. For example, FIG. 1 shows three distinct sections 3, 4, 5, each having a different yet uniform ratio of high/low explosive. An example of three ratios corresponding to the three sections 3, 4, 5 in FIG. 1 could be 85/15, 60/40, to 30/70, e.g., increasing the ratio of Black Powder near the low explosive 6. A cap 7 can be located at the end of the explosive tube 8. The low explosive portion 6 can be considered to be a booster portion. Alternatively, the low explosive portion 6 and the transition portion 5 together could even be considered to be a booster portion. The booster portion can itself be a propellant, or can be used to ignite propellant.

A detonator 10 is shown connected with the high explosive 2. The detonator 10 can be a percussion detonator that detonates the high explosive 2 by percussive force applied to the high explosive 2. The detonator 10 could also be an electrical detonator that detonates the high explosives 2 by electrical current applied to the high explosive 2.

In operation, if high explosive 2 were to be directly adjacent to low explosive 6, a shock created by detonation of the high explosive 2 could negatively impact the low explosive 6, e.g., disrupt or compact the low explosive 6, in such a manner that deflagration of the low explosive 6 could be disrupted. As shown in FIG. 1, the presence of the transition zone 9 allows for a transition from detonation of high explosive to deflagration of low explosive between high explosive 2 and low explosive 6, thereby producing advantageous effects.

The embodiments referred to above are meant to illustrate a number of embodiments including a number of features included in the inventive idea. The embodiments are in no way meant to limit the scope of the claims herein.

The invention claimed is:

1. A detonating device, comprising:

a detonator connected with a high explosive portion comprising high explosive;

a low explosive portion comprising low explosive;

a transition portion between the high explosive portion and the low explosive portion, wherein the transition portion comprises a mixture of high explosive and low explosive; and an elongated tubular member, the high explosive portion being within the elongated tubular member, the transition portion being within the elongated tubular member, and the low explosive portion being within the tubular member.

2. The detonation device of claim 1, wherein the high explosive portion comprises a detonating cord.

3. The detonating device of claim 1, wherein the low explosive portion comprises black powder.

4. The detonating device of claim 1, wherein the high explosive comprises RDX.

5. The detonating device of claim 4, wherein the transition portion comprises a mixture of RDX and low explosive.

6. The detonating device of claim 5, wherein the low explosive comprises black powder.

7. The detonating device of claim 5, wherein in the transition portion has a first ratio of high/low explosive at an end proximate to the high explosive portion and a second ratio of high/low explosive at an end distal to the high explosive portion, the first ratio being greater than the second ratio.

8. The detonating device of claim 7, wherein the transition portion comprises a plurality of distinct sections, each section having a different ratio of high/low explosive.

9. The detonation device of claim 8, comprising at least three distinct sections.

10. The detonating device of claim 9, wherein the transition portion is entirely within the tubular member.

11. The detonating device of claim 1, wherein the detonator is a percussion detonator.

12. The detonating device of claim 1, wherein the detonator is an electrical detonator.

13. The detonating device of claim 1, wherein the low explosive portion comprises a booster portion.

14. The detonator device of claim 1, wherein the high explosive has a detonation rate within the range of 1,000 meters per second to 9,000 meters per second.

15. The detonator device of claim 1, wherein the low explosive has a deflagration rate within the range of a few centimeters per second to approximately 400 meters per second.

16. A method of actuating low explosive with high explosive with a detonation device, the detonating device having a detonator connected with a high explosive portion; a low explosive portion; and a transition portion between the high explosive portion and the low explosive portion, wherein the transition portion comprises a mixture of high explosive and low explosive, an elongated tubular member, the high explosive portion being within the elongated tubular member, the transition portion being within the elongated tubular member, and the low explosive portion being within the tubular member, the method comprising:

detonating the high explosive portion with the detonator thereby transmitting detonation to the transition portion and subsequently igniting deflagration in the low explosive portion.

17. The method of claim 16, wherein the detonator is a percussion detonator.

18. The method of claim 16, wherein the detonator is an electrical detonator.

* * * * *